US006796433B2

(12) United States Patent
Daniels, Jr. et al.

(10) Patent No.: US 6,796,433 B2
(45) Date of Patent: Sep. 28, 2004

(54) METHOD OF POST PROCESSING OCR INFORMATION OBTAINED FROM MAILPIECES USING A CUSTOMER SPECIFIC KEYWORD DATABASE AND A MAILPIECE SORTING APPARATUS

(75) Inventors: Edward P. Daniels, Jr., Trumbull, CT (US); Robert K. Gottlieb, Milford, CT (US)

(73) Assignee: Pitney Bowes Inc., Stamford, CT (US)

( * ) Notice: Subject to any disclaimer, the term of this patent is extended or adjusted under 35 U.S.C. 154(b) by 172 days.

(21) Appl. No.: 10/042,418

(22) Filed: Nov. 7, 2001

(65) Prior Publication Data

US 2003/0085162 A1 May 8, 2003

(51) Int. Cl.[7] ..... B07B 1/52
(52) U.S. Cl. ..... 209/384; 700/224
(58) Field of Search ..... 209/384, 546, 209/584, 400; 700/224, 214, 219

(56) References Cited

U.S. PATENT DOCUMENTS 4,632,252 A 12/1986 Haruki et al. ..... 209/546
4,992,649 A 2/1991 Mampe et al. ..... 235/462
5,538,138 A 7/1996 Reich ..... 209/3.3
5,697,504 A 12/1997 Hiramatsu et al. ..... 209/546
5,734,568 A * 3/1998 Borgendale et al. ..... 700/224
6,259,964 B1 * 7/2001 Robinson ..... 700/224

* cited by examiner

*Primary Examiner*—Kenneth Noland
(74) *Attorney, Agent, or Firm*—Christopher J. Capelli; Angelo N. Chaclas

(57) ABSTRACT

The an embodiment of the present invention generally comprises a mailpiece sorting apparatus including a customer specific keyword database and a method of post processing OCR reject mailpieces. Mailpieces that the OCR cannot read and determine the recipient for ("rejects") are post processed using the customer specific keyword database which contains information regarding addressee field that is particular to the customer. Address cleansing is performed to the information obtained from the OCR system and an addressee match is attempted. If a match is made, the mailpiece is delivered to an appropriate sort bin. If a match is not made then the mailpiece is delivered to a reject bin. The method provides for better automated throughput of sorted mailpieces.

10 Claims, 8 Drawing Sheets

METHOD OF POST PROCESSING OCR INFORMATION OBTAINED FROM MAILPIECES USING A CUSTOMER SPECIFIC KEYWORD DATABASE AND A MAILPIECE SORTING APPARATUS

FIELD OF THE INVENTION

The invention disclosed herein relates generally to automated mail sorting and more particularly, a method of post processing addressee information using a keyword database to determine the intended mailpiece destination.

BACKGROUND OF THE INVENTION

The processing and handling of mailpieces consumes an enormous amount of human and financial resources, particularly if the processing of the mailpieces is done manually. The processing and handling of mailpieces not only takes place at the Postal Service, but also occurs at each and every business or other site where communication via the mail delivery system is utilized. That is, various pieces of mail generated by a plurality of departments and individuals within a company need to be addressed, collected, sorted and franked as part of the outgoing mail process. Additionally, incoming mail needs to be collected and sorted efficiently to ensure that it gets to the addressee (i.e. employee or department) in a minimal amount of time. Since much of the documentation and information being conveyed through the mail system is critical in nature relative to the success of a business, it is imperative that the processing and handling of both the incoming and outgoing mailpieces be done efficiently and reliably so as not to negatively impact the functioning of the business.

Various automated mail handling machines have been developed for processing incoming mail (removing individual pieces of mail from a stack and performing subsequent actions on each individual piece of mail). Generally, the mail handling machines separate individual mailpieces from a stack, read the mailpieces using an optical character recognition (OCR) system and compare the read information to an addressee database in order to determine the appropriate destination points for delivery of the mailpieces. Some of the incoming mail received at a mailroom of the company can be unreadable by the OCR system, the quantity of which can be great since recipients cannot control the addressee format in which the incoming mail is received. Some of the unreadable mail could be, for example, mail which is not OCR readable "OCR rejects" (i.e. smeared or needs to be opened to determine addressee), "mystery mail" which mail with no particular addressee (i.e. mail addressed to a company or department only or mail with poor quality handwriting), or "research mail" (i.e. mail that can not be read by OCR but does not require opening for the operator to determine the addressee, including the situation where there are several potential addressees with the same name). The unreadable mail, which will be referred to generally as "reject mail" is expensive to process since it drains the resources of the mail room requiring additional time and labor for sorting and delivery. Therefore, it would be helpful if the mailpieces for which an intended recipient has not been identified could be processed additionally, quickly and in an automated fashion so as not to encumber the resources of the mailroom.

Previously, if a determination could not be made by the incoming mail handling machine as to the addressee, a video image of the mailpiece was viewed by an operator and in the case where the addressee image was readable by the operator, addressee information was keyed into the system and associated with an identification number for the mailpiece. This is typically done after the unreadable mailpieces are sorted into a reject bin because it requires time to make the determination and provide the information to the system for proper sorting. The previously rejected mailpieces are then resorted by reading the identification information which can be printed on the mail during the first sort. The identification information is linked with the addressee information manually keyed in by the operator during the reject processing/video coding sequence and is used to sort the mailpiece to the proper destination bin.

Video processing of mailpieces has been performed at on-site video coding terminals or off-site video coding facilities where the video image is transmitted for determination of addressee by an operator. The information is then transferred back to the sorting apparatus. The software and hardware costs associated with video processing can be high because video coding requires additional computer systems, image servers and workstations. Additionally, licensing fees for video coding software can be expensive. Video coding can also be labor intensive because the operator has to input information using a keyboard. While predictive keying can be used, the operator is still bogged down with using his or her hands to input addressee information. Thus, a separate video coding operator is needed in apart from the incoming mailpiece sorting apparatus operator in order to keep throughput on the sorting apparatus while processing rejects.

Thus one of the problems of the prior art is that a system is not available for providing additional automated identification of addressees or destinations. Another problem of the prior art is that a system is not available which provides higher throughput and decreased labor costs. Another problem of the prior art is that is can be expensive. Yet another problem of the prior art is that incoming mail handling machines do not include additional functionality for using automation to determine the intended recipient. Therefore, a method of processing mailpieces with unidentifiable addressees (rejects) is needed which integrates reject processing with the mailpiece sorting apparatus with increased read rates and with greater throughput.

SUMMARY OF THE INVENTION

This invention overcomes the disadvantages of the prior art by providing a method of processing reject mailpieces with better throughput and lower labor costs. This in turn affords quicker mailpiece processing. The present invention is directed, in general to automated mailpiece sorting apparatus and more particularly, a method of processing rejected mailpieces using an automated mailpiece sorting apparatus with a customer specific (i.e. employer/company using the mail sorting apparatus) keyword database and processing addressee information to increase the identification rate of the intended recipient(s) of mailpieces. The mailpiece sorting apparatus may generally comprise a feeder, a scanner, a mailpiece deliverer, compartments or bins for receiving sorted mailpieces, optical character recognition system (OCR) for reading addressee information, a personal computer (PC) or microprocessor based control system, recipient matching software and an addressee database. The mailpiece sorting apparatus of the present invention also comprises a customer specific keyword database for post OCR processing of mailpieces.

In an embodiment of the present invention, mailpieces are sorted by the mailpiece sorting apparatus during a first-pass sort (i.e. on first pass mailpieces are divided into available bins, on next pass, mailpieces from one or more bins of the first pass are resorted into available bins). Mailpieces that can be read and addressees identified using the OCR system or the post OCR processing application are sent to their designated sort bins. Mailpieces that the mailpiece sorting apparatus OCR system and post OCR processing application cannot determine the recipient for ("rejects") are sent to a reject bin. Once the first pass sorting is completed, the rejects may be processed using a reject sorting mode such as video coding, manual identification or voice recognition system or other system determined by one of ordinary skill in the art using factors such as cost and throughput.

An advantage of the method of the present invention is that it provides higher throughput with minimal additional hardware, software and labor costs. Another additional advantage of the present invention is that there is higher throughput of sorted mailpieces. Another advantage of the present invention is that it allows for additional automated processing. Other advantages of the invention will in part be obvious and will in part be apparent from the specification. The aforementioned advantages are illustrative of the advantages of the various embodiments of the present invention.

DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE PRESENT INVENTION

Figure 1:
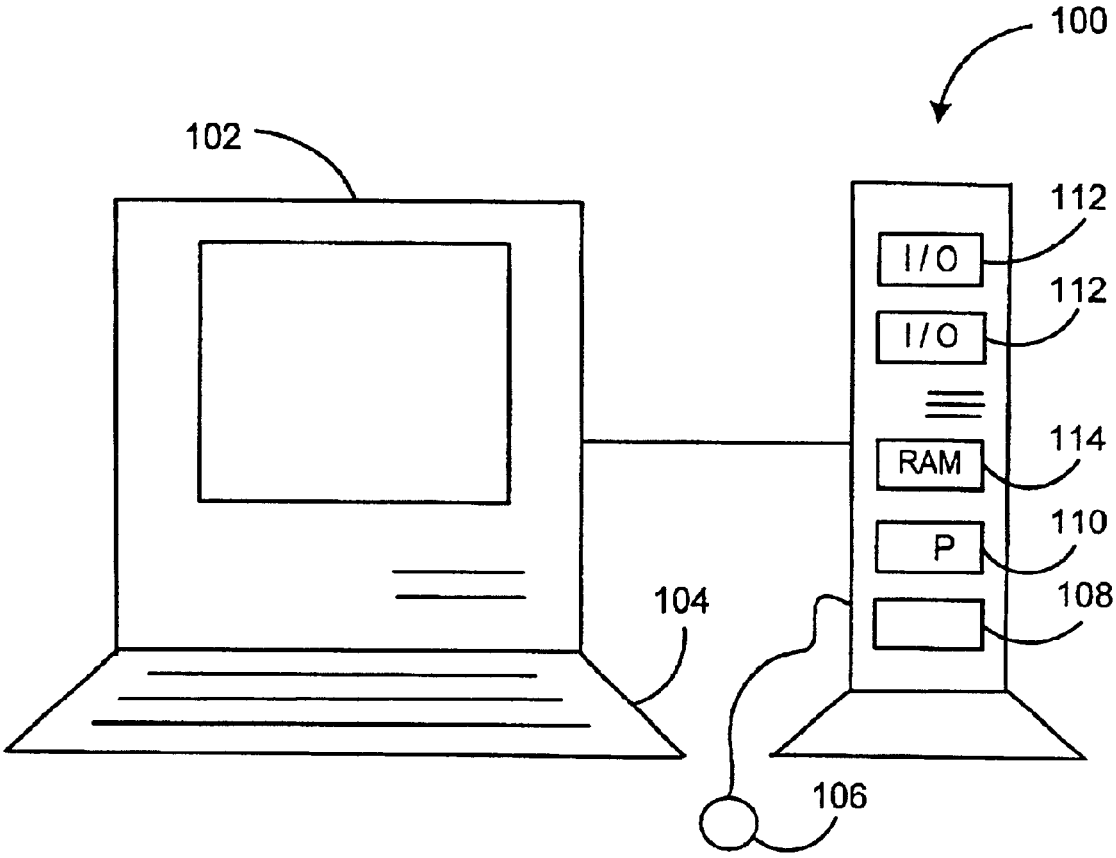
FIG. 1 is a block diagram that illustrates a computer system upon which an embodiment of the invention may be implemented.

In describing the present invention, reference will be made herein to FIGS. 1–6 of the drawings in which like numerals refer to like features of the invention. Features of the invention are not necessarily shown to scale in the drawings.

Hardware Overview

FIG. 1 is a block diagram that illustrates a computer system 100 upon which an embodiment of the invention may be implemented. Computer system 100 may be a personal computer which is used generically and refers to present and future microprocessing systems with at least one processor operatively coupled to user interface means, such as a display 102 and keyboard 104, and/or a cursor control, such as a mouse or a trackball 106, and storage media 108. The personal computer 100 may be a workstation that is accessible by more than one user. The personal computer also includes a conventional processor 110, such as a Pentium® microprocessor manufactured by Intel, and conventional memory devices such as hard drive 108, floppy drive(s) 112, and memory 114.

Figure 2A:
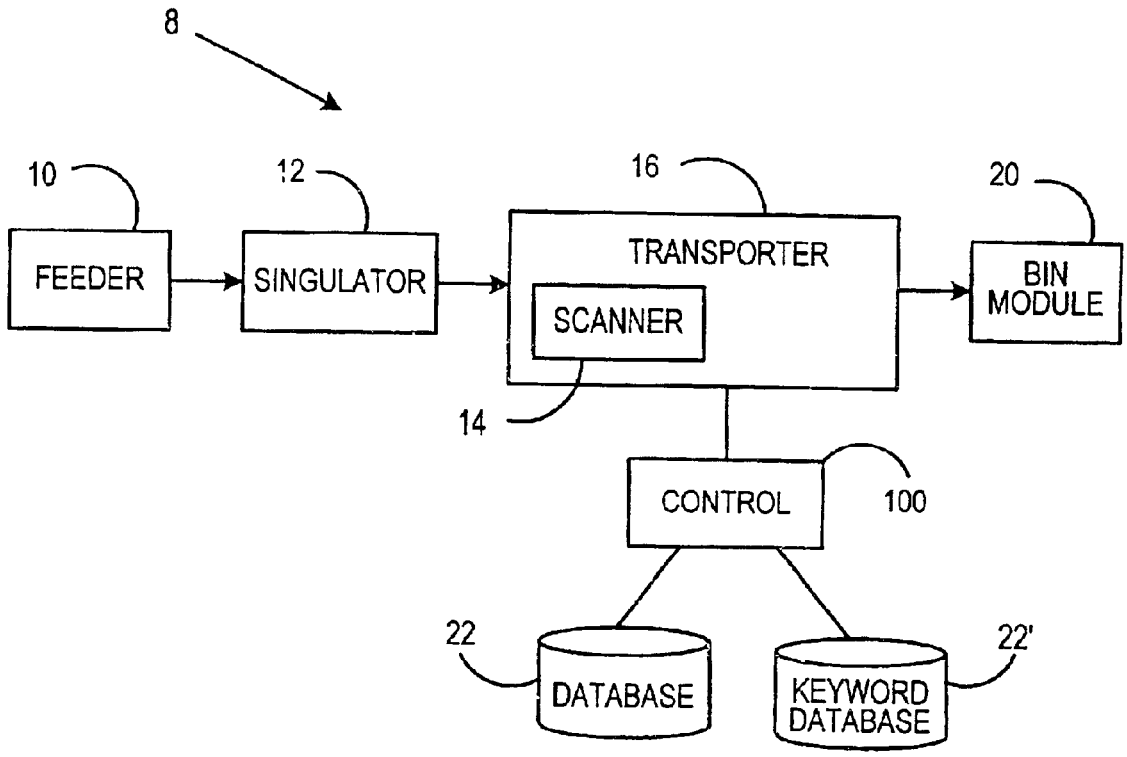
FIG. 2*a* illustrates the connection of the computer system to the sorting apparatus.
Figure 2B:
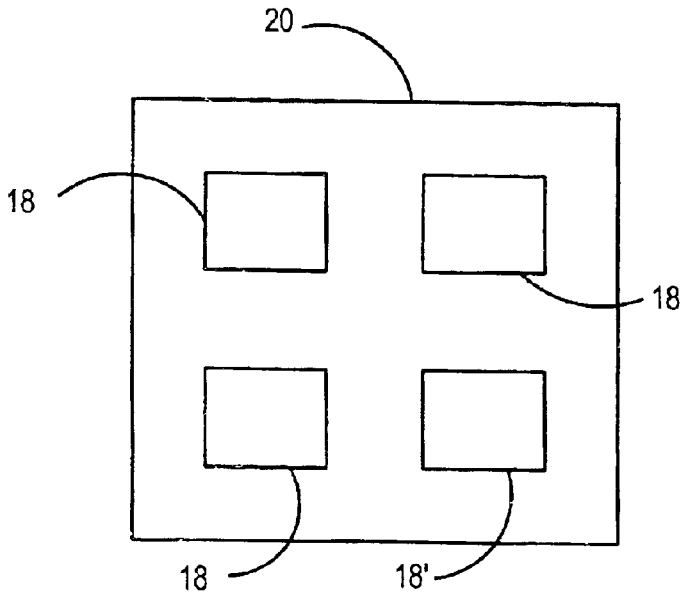
FIG. 2*b* is a block diagram illustrating a four bin module which may be part of the mailpiece sorting apparatus used to perform an embodiment of the method of the present invention.

The computer system 100 can be connected to a sorting apparatus 8 as illustrated in FIG. 2*a*. The mailpiece sorting apparatus 8 may generally comprise a feeder 10, a line scan camera 14 (and OCR software, not shown), a mailpiece transporter 16, a bin module 20 (shown in FIG. 2*b*) with compartments or bins 18, 18' for receiving sorted mailpieces 30 and a control system 100 which may be the microprocessor based personal computer system described above. The computer system 100 can run the voice recognition software. The computer system 100 includes appropriate memory devices 108, 114 for storage of information such as an address database 22. One of ordinary skill in the art would be familiar with the general components of the sorting apparatus upon which the method of the present invention may be performed.

The mailpiece sorting apparatus 8 and the OCR software may be used to determine the addressee of the mailpiece 30 or other information on the face of the mailpiece 30. The reading of various information may be performed with the assistance of intelligent character recognition (ICR) or imaging and character recognition (OCR/IC) which may be part of the above mentioned OCR software and can read the various fields on the mailpiece 30.

Reject Mailpieces

Figure 3A:
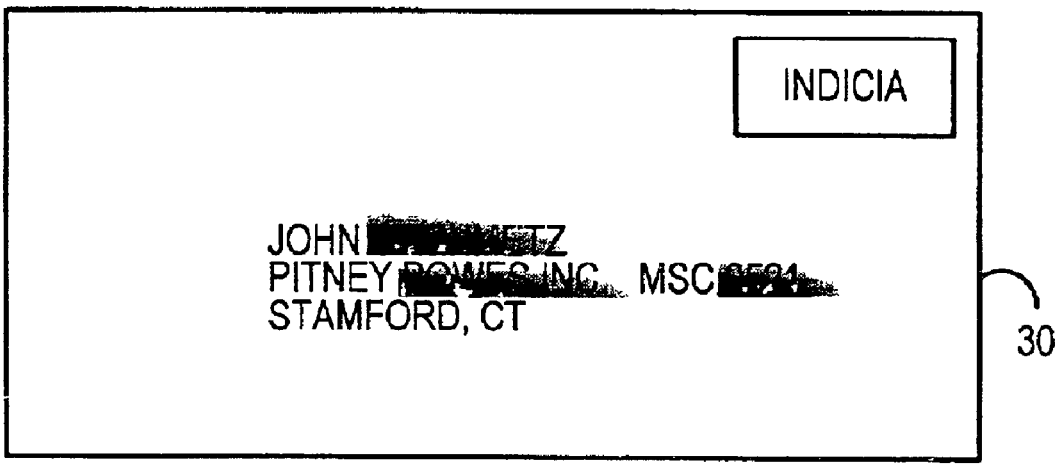
FIGS. 3*a*–3*b* illustrate various reject mailpieces.
Figure 3B:
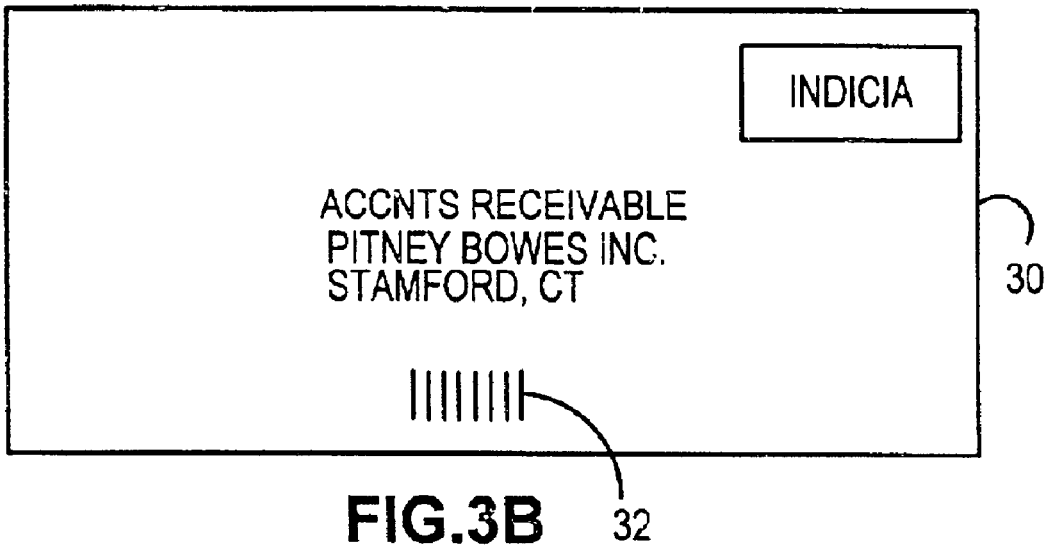

FIGS. 3*a*–3*b* illustrate various reject mailpieces 30 which can be unidentifiable by an OCR system. Post processing of the present invention can increase the read rate of reject mailpieces. The term "post processing" of OCR information refers to processing after the OCR system has attempted to make identification of the addressee. FIG. 3*a* is an example of a reject mailpiece 30 which is unreadable by the OCR system because the addressee information determined by the OCR system does not match information in the addressee database ("OCR Reject"). However, some of the information may be identifiable using a customer specific keyword database (the term customer specific refers to a particular customer or business using the mailpiece sorting apparatus to sort mailpieces). The addressee database has various fields that contain addressee information including addressee name field and an addressee location field. The customer specific keyword database contains information relating to the fields contained in the addressee database. For example, the address database location field may contain locations such as mailstop codes. Additional information such as, for example, mailstops are numeric only, receivable is in the destination name of only one department, there are 20 floors in the destination floor field and no $13^{th}$ floor may also be included in the customer specific keyword database.

For a specific customer or company, such as the example customer incoming mailpiece of FIG. 3*a*, the mailstop codes are numeric in nature (not alpha-numeric). This information can be contained in the customer specific keyword database. Using this example, if the OCR were to read a mailstop code from a mailpiece and determine that the code was "OS21", no match would be made to a particular addressee since the customer's mailstop codes are not alpha numeric. Since a match was not made, post processing is performed. During post processing, the mailcode is cleansed using customer specific keyword information. Since in this example, the customer's mailstop codes are numeric only, the OCR result mailstop "OS21" is cleansed and is now interpreted as "Ø521". A match can then be made to information in the addressee database.

In another example, for the incoming mailpiece of FIG. 3*b*, the OCR determines from a mailpiece that the destination is "accnts receivable". No match can be found in the addressee database. Using post processing, the customer specific keyword database indicates that only one department destination for the customer includes the word "receivable", in this example the department is "accounts receivable", the addressee destination is interpreted as "accounts receivable". A match can then be made to information in the addressee database.

Post Processing of Addressee Information

The present invention is related to the use of computer system 100 connected to the mailpiece sorting apparatus 8 for performing application software methods. The method of the present invention is used to post process mailpieces 30 which are unidentifiable by the OCR system ("reject" mailpieces) in order to determine the appropriate addressee, intended destination or recipient.

Figure 4A:
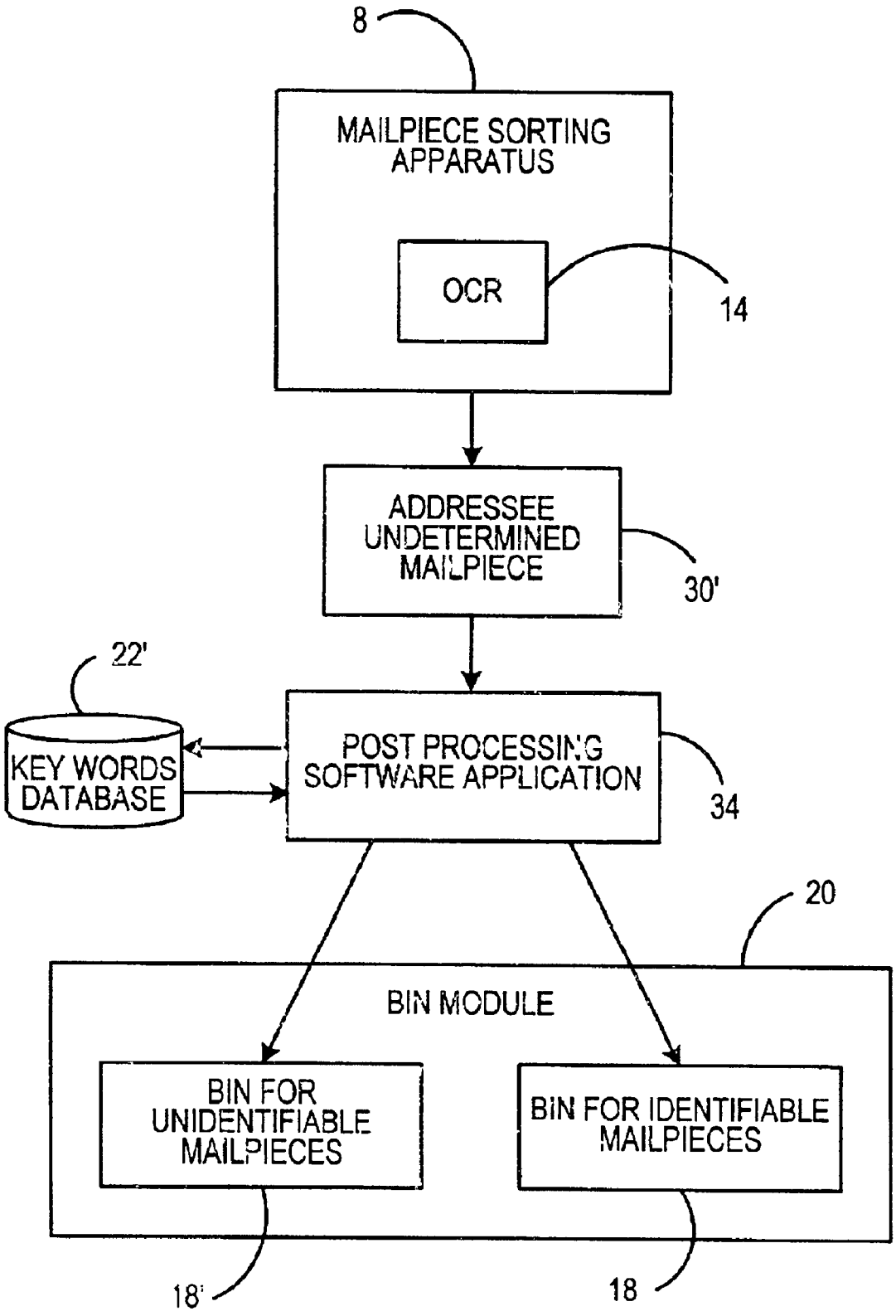
FIG. 4*a* illustrates a functional block diagram of an embodiment of the method and apparatus of the present invention.

FIG. 4*a* is a functional block diagram of an embodiment of the method and apparatus of the present invention illustrating the flow of a post processing application. The mailpiece sorting apparatus 8 and OCR 14 pass reject mailpiece information to a post processing software application 34 which uses a keyword database 22' to attempt to determine an appropriate addressee for the previously unidentifiable addressee of mailpiece 30. If the addressee is identifiable using the post processing software application 24 and keyword database 22' then the mailpiece is sorted to a sort bin 18 for identifiable mailpieces. If the addressee is not identifiable using the post processing software application 24 and keyword database 22' then the mailpiece is sorted to a reject bin 18' (shown in FIG. 2*b*). The bins may be in one or more bin module(s) 20 (shown in FIGS. 2*a–b*).

Figure 4B:
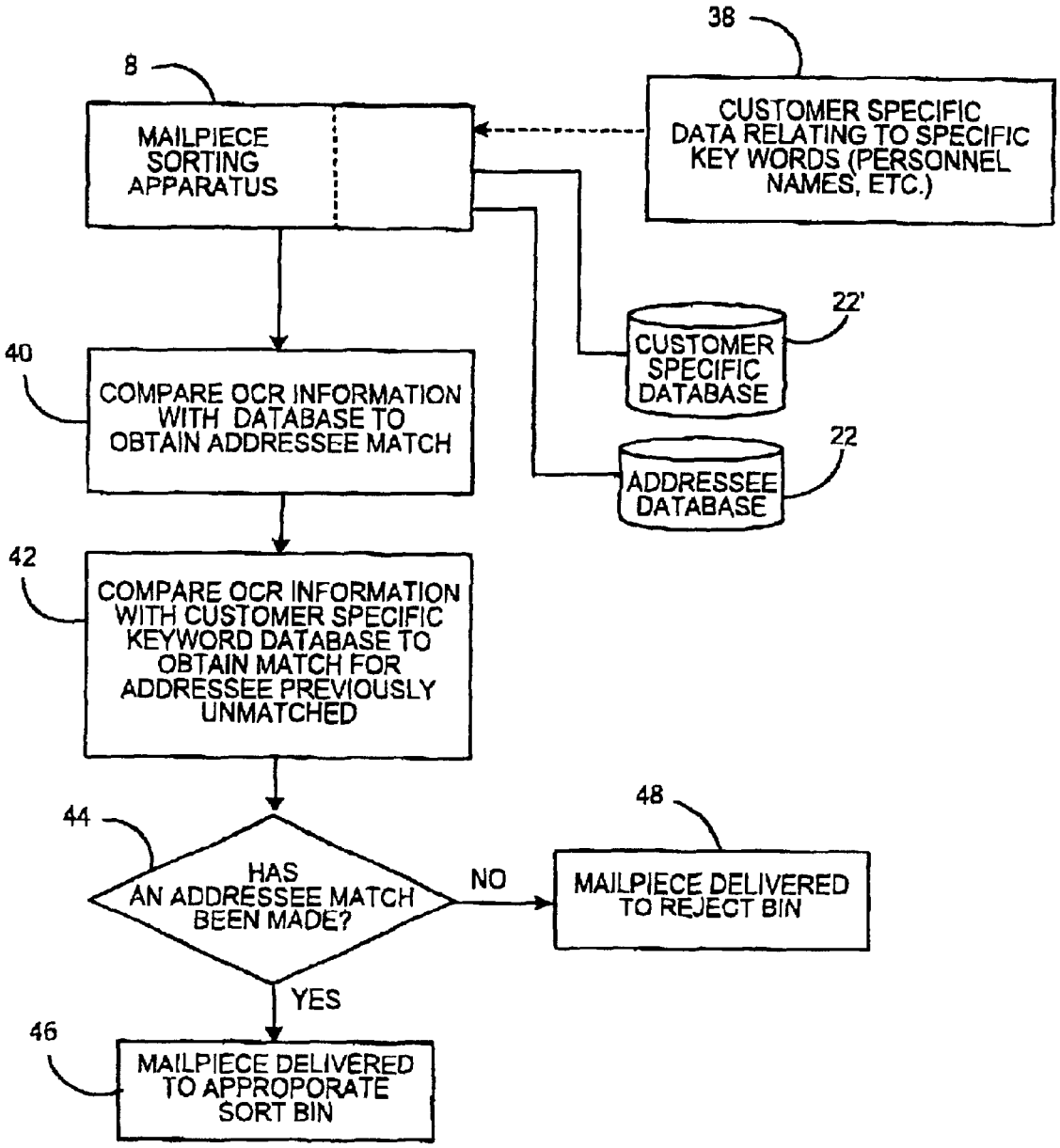
FIG. 4*b* is an upper level flow chart illustrating the post process method of an embodiment of the present invention.

FIG. 4*b* is an upper level flow chart illustrating the post process method of an embodiment of the present invention. Mailpiece sorting apparatus 8 is connected to an addressee database 22 and a customer specific keyword database 22'. Block 38 illustrates customer specific data entry relating to specific keywords such as, for example, department names (payable, human, company specific building names) etc. This information is stored in database 22'. At block 40 the OCR system of mailpiece sorting apparatus 8 makes a comparison of information obtained by the OCR system with an addressee database to attempt to find an addressee match. At block 42, for mailpieces for which a match was not made at block 40, a comparison of information obtained by the OCR system is made to the customer specific keyword database. At block 44 a query is made as to whether an addressee match has been made. If an addressee match has been made, at block 46, the mailpiece(s) are delivered to appropriate bin(s) 18. If an addressee match has not been made, at block 48, the mailpiece(s) are delivered to a reject bin 18'.

Figure 5:
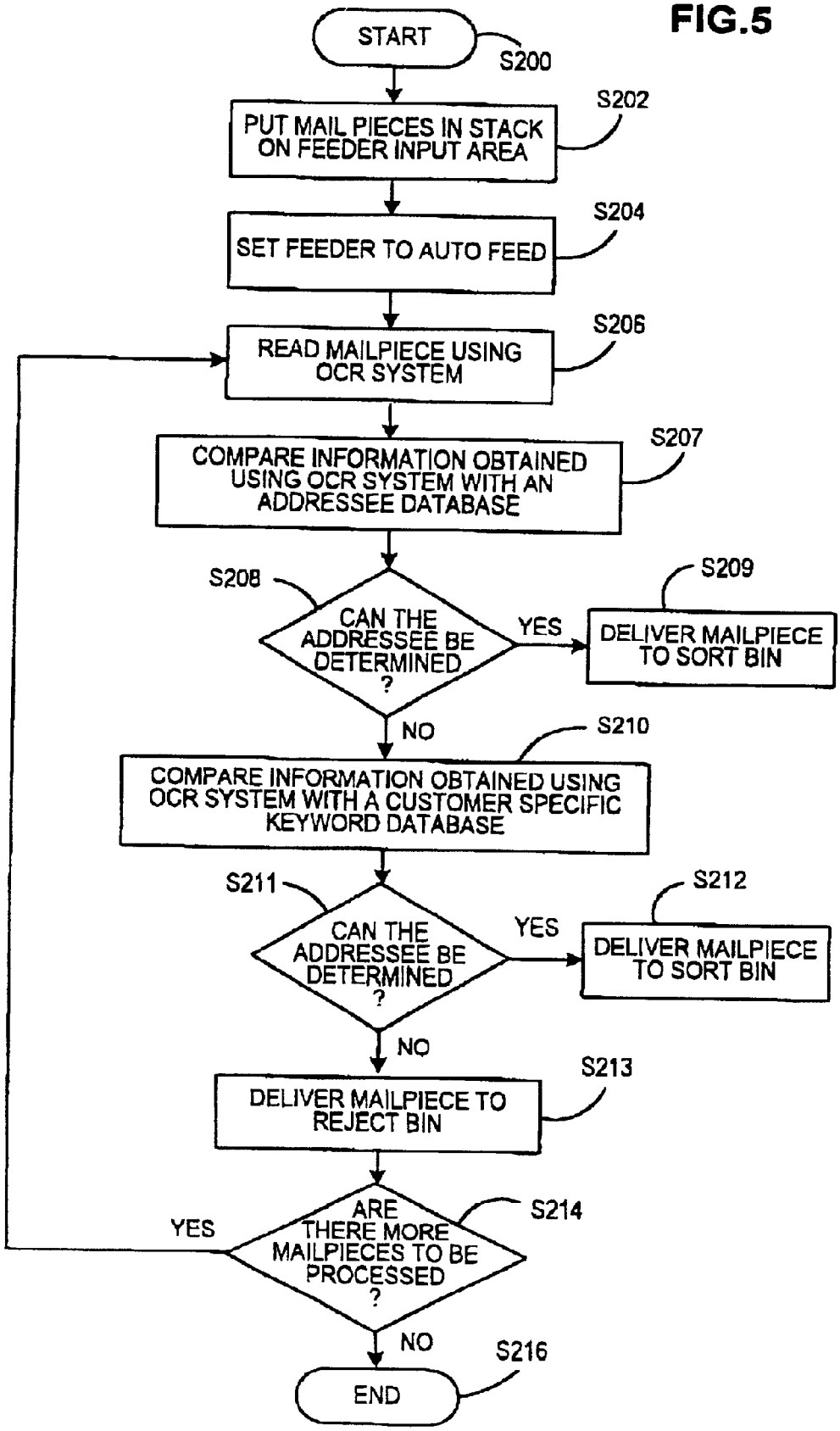
FIG. 5 is a flowchart of an embodiment of the post processing method of in the present invention in a single sort pass scenario.

FIG. 5 is a flowchart of an embodiment of the post processing method of the present invention in a single sort pass scenario. At step S200 the method begins. At step S202 a stack of mailpieces (not shown) is placed on the feeder 10 of the mailpiece sorting apparatus 8. At step S204 the feeder 10 is set to auto feed and the mailpieces 30 are moved along the feedpath the mailpiece sorting apparatus 8. At step S206 the mailpieces 30 are read using the OCR system. At step S207 information obtained using the OCR system is compared to information in a addressee database 22 of the mailpiece sorting apparatus 8. At step 208 a query is made as to whether the addressee can be determined from the information read by the OCR system. If the answer to the query S208 is yes, then the mailpiece 30 is delivered to the appropriate sort bin 18 at step S209. If the answer to the query S208 is no, then information obtained by the OCR system is compared with a customer specific (the term "customer specific" refers to a particular customer or business using the mailpiece sorting apparatus to sort mailpieces) keyword database 22' of the mailpiece sorting apparatus 8. If the answer to the query S208 is no, then the information obtained using the OCR system is compared to information in a customer specific keyword database at step S210. Next, at step S211 a query is made as to whether the addressee can be determined. If at step S211 the addressee can be determined, then at step S212 the mailpiece is delivered to an appropriate sort bin. If at step S211 the appropriate addressee cannot be determined, then the mailpiece is delivered to a reject bin 18' at step S213. Next, a query is made at step S214 as to whether there are additional mailpieces 30 to be processed. If the answer to the query of step S214 is yes, then steps S206 through S214 are performed until no mailpieces 30 are left to be processed. It the answer to the query at S214 is no, then the method ends at S216.

Reject mailpieces may be processed further using other methods such as, for example, video coding or voice recognition. Such additional processing may be determined by one of ordinary skill in the art; cost and throughput factors may be used in making the determination.

Figure 6A:
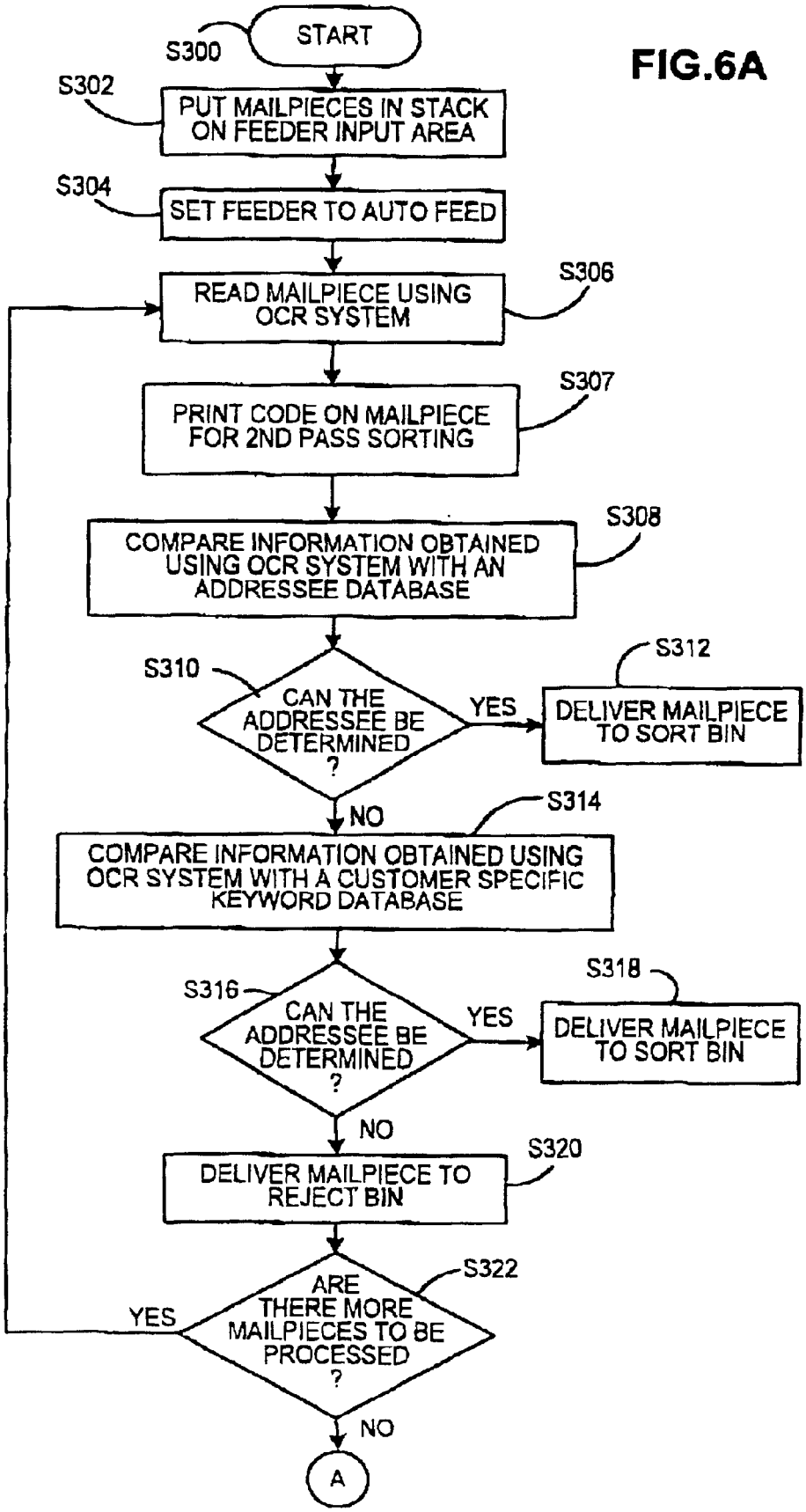
FIGS. 6*a*–*b* illustrate a flowchart of an embodiment of the post processing method of the present invention in a multiple sort pass scenario.
Figure 6B:
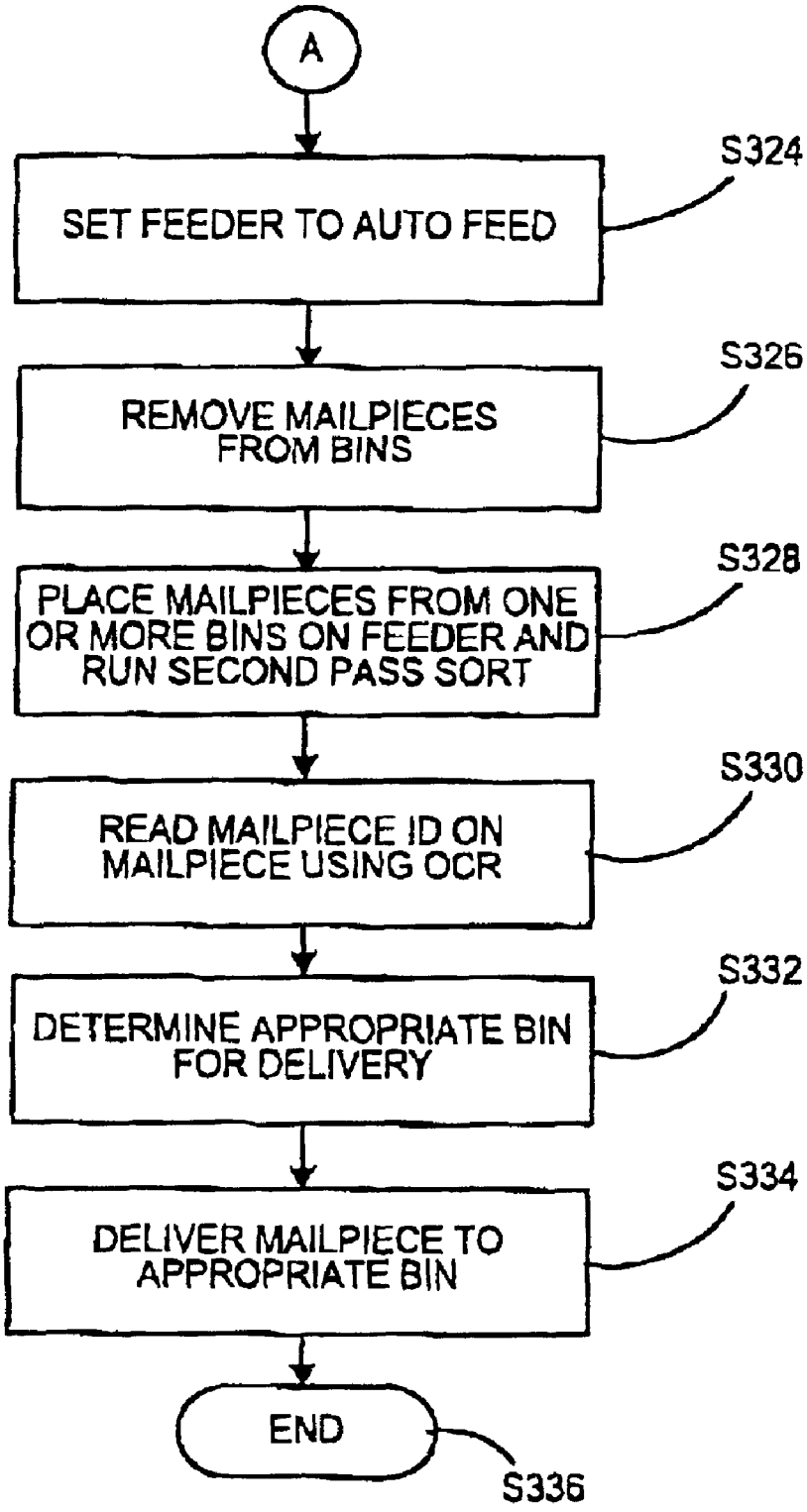

FIGS. 6*a–b* illustrate a flowchart of an embodiment of the post processing method of the present invention in a multiple sort pass scenario. At step S300 the method begins. At step S302 a stack of mailpieces (not shown) is placed on the feeder 10 of the mailpiece sorting apparatus 8. At step S304 the feeder 10 is set to auto feed and the mailpieces 30 are moved along the feedpath the mailpiece sorting apparatus 8. At step S306 the mailpieces 30 are read using the OCR system. At step S307 a code is printed on the mailpiece 30 for second pass sorting and/or reject processing. At step S308 information obtained using the OCR system is compared to information in a addressee database 22 of the mailpiece sorting apparatus 8. At step S310 a query is made as to whether the addressee can be determined from the information read by the OCR system. If the answer to the query S310 is yes, then the mailpiece 30 is delivered to the appropriate sort bin 18 at step S312. If the answer to the query S310 is no, then information obtained by the OCR system is compared with a customer specific keyword database 22' of the mailpiece sorting apparatus 8 at step S314. Next, at step S316 a query is made as to whether the addressee can be determined. If at step S316 the addressee can be determined, then at step S318 the mailpiece is delivered to an appropriate sort bin. If at step S316 the appropriate addressee cannot be determined, then the mailpiece is delivered to a reject bin 18' at step S320. Next, a query is made at step S322 as to whether there are additional mailpieces 30 to be processed. If the answer to the query of step S322 is yes, then steps S306 through S322 are performed until no mailpieces 30 are left to be processed.

If the answer to the query at S322 is no, then the method proceeds with a second pass sort for previously identifiable mailpieces sorted to bin(s) 18. Mailpieces which were sorted to reject bin 18' can be further processed using a technique such as video coding or voice recognition explained above, prior to second pass sorting performed in steps S324–S334.

At step S324 the feeder 10 is set to automatic feed. At step S326 the mailpieces 30 are removed from the bins 18, 18'. At step S328 the mailpieces 30 which were removed from one or more bins 18 are placed on the feeder 10 for a second pass sort. The determination as to which mailpiece 30 are run through the second pass sort is made by the operator and the equipment in coordination with a previously determined sort scheme which may be determined by one of ordinary skill in the art. At step S330 the OCR reads the mailpiece ID 32 (shown in FIG. 3*b*) on the mailpieces (the mailpiece ID 32 was printed on the mailpiece during the first pass sort at step S307). At step S332 the mailpiece sorting apparatus 8 determines the appropriate bin 18 for delivery of the mailpiece. At step S334 the mailpiece 30 is delivered to the appropriate bin 18, 18'. The operation continues until all mailpieces are sorted. At step S336, the method ends.

An additional feature of the present invention tracks and calculates statistical information regarding the rejects, the number of mailpieces successfully post processed and the total number of rejects as compared to the total number of mailpieces sorted. The mailpiece sorting apparatus could generate report(s) detailing counts of the different types of rejects and post processed rejects as well as operator productivity measurements.

The present invention provides for better throughput and decreased sorting costs. It provides the ability to customize OCR decision making without requiring changes to the general OCR decision making method. It further provides the ability to adapt the post processing database over time to provide increased sort rates as the customers database information changes. While the present invention has been disclosed and described with reference to a single embodiment thereof, it will be apparent, as noted above that variations and modifications may be made therein. It is, thus, intended in the following claims to cover each variation and modification that falls within the true spirit and scope of the present invention.

What is claimed is:

1. A method of determining an intended addressee of a mailpiece using an incoming mailpiece sorting apparatus with an OCR system, the method comprising the steps of:

a) adjusting a post OCR database coupled to the incoming mailpiece sorting apparatus to attempt to determine the intended addressee of the mailpiece if the OCR system was unable to determine the intended addressee of the mailpiece; and b) storing information about the number of mailpieces processed including a number of reject mailpieces processed, a number of mailpieces which were automatically readable and for which addressee segments from the mailpiece were matched to the addressee information from the OCR system or the post OCR database: and c) calculating statistical information using the incoming mailpiece sorting apparatus.

2. The method as claimed in claim 1 further comprising the step of:

d) delivering the mailpiece to a designated sort bin, if the intended recipient of the mailpiece is determined using the post OCR database.

3. The method as claimed in claim 1 further comprising the step of:

d) delivering the mailpiece to a designated reject sort bin, if the intended recipient of the mailpiece is not determined using the post OCR database.

4. A method of sorting mailpieces using an incoming mailpiece sorting apparatus comprising a feeder, an OCR system, a control system and two or more sort bins, the method comprising the steps of:

a) providing an OCR database coupled to the OCR system of the incoming mailpiece sorting apparatus, the OCR database containing addressee information;

b) providing a post OCR database coupled to the control system of the incoming mailpiece sorting apparatus;

c) processing a mailpiece by using the OCR database to attempt to determine the intended recipient of the mailpiece;

d) delivering the mailpiece to a designated sort bin of the two or more sort bins, if the intended recipient of the mailpiece is determined using the OCR database;

e) processing the mailpiece using the post OCR database, if the intended recipient of the mailpiece is not determined using the OCR database;

f) delivering the mailpiece to a designated sort bin of the two or more sort bins, if the intended recipient of the mailpiece is determined using the post OCR database;

g) delivering the mailpiece to a designated reject sort bin of the two or more sort bins, if the intended recipient of the mailpiece is not determined using the post OCR database;

h) storing information about the number of mailpieces processed including a number of reject mailpieces processed, a number of mailpieces which were automatically readable and for which addressee segments from the mailpiece were matched to the addressee information in the OCR database or the post OCR database; and i) calculating statistical information using the mailpiece sorting apparatus.

5. The method as claimed in claim 4 wherein in step a) the OCR database comprises addressee information in data fields.

6. The method as claimed in claim 4 wherein in step b) the post OCR database comprises characteristic information about the addressee information in the data fields of the OCR database.

7. An mailpiece sorting apparatus for processing reject mailpieces, the mailpiece sorting apparatus configured to processes a stack of mailpieces along a feed path and reading each mailpiece from the stack of mailpieces as each mailpiece travels along the feed path and through an OCR station, the mailpiece sorting apparatus further configured for processing individual reject mailpieces for which the addressee was unidentifiable through the use of the OCR station, the apparatus comprising:

a feed station for feeding and separating the stack of mail;

two or more bins for receiving mailpieces after the mailpieces travel along the feed path; and the OCR station for reading addressee information from the mailpieces as they are moved along the feed path and interpreting addressee information;

a software system and a first and second database for identifying the addressee and determining an appropriate delivery bin from the two or more bins for receiving the mailpieces, the first database being an OCR database and containing addressee information, the second database being a post OCR database containing characteristic information about the addressee information in the OCR database;

whereby if addressee information is identifiable by the OCR system or the post OCR database, the mailpiece is delivered to an appropriate sort bin of the two or more bins for receiving the mailpieces;

a voice recognition system coupled to the mailpiece sorting apparatus for inputting address information that was unidentifiable by the OCR system and the post OCR database; and whereby if humanly identifiable information is available from the mailpiece that was unidentifiable by the OCR station, an operator inputs the humanly identifiable addressee information from the mailpiece into the voice recognition system so that the mailpiece can be delivered to the appropriate delivery bin from the two or more bins for receiving the mailpieces.

8. The apparatus as claimed in claim 7 wherein the post OCR database comprises characteristic information regarding various fields in the OCR database.

9. The apparatus as claimed in claim 8 wherein the characteristic information comprises whether a field is alphanumeric.

10. The apparatus as claimed in claim 8 wherein the characteristic information comprises information about whether a field shares common identification characteristics with other information in the same field.

* * * * *